United States Patent [19]

Young

[11] 4,009,373

[45] Feb. 22, 1977

[54] ELECTRO-MECHANICAL COUNTING REGISTER

[75] Inventor: Einar T. Young, Largo, Fla.

[73] Assignee: Suntech, Inc., St. Davids, Pa.

[22] Filed: Dec. 11, 1975

[21] Appl. No.: 640,104

[52] U.S. Cl. ..... 235/92 FL; 235/92 C; 235/92 R; 235/134; 235/144 D; 235/144 SP

[51] Int. Cl.[2] ..... G06M 1/30; G06M 1/16

[58] Field of Search ..... 235/92 C, 92 K, 92 FL, 235/134, 144 D, 144 SP, 144 M, 144 R, 61 M

[56] References Cited

UNITED STATES PATENTS

| | | | |
|---|---|---|---|
| 2,289,869 | 7/1942 | Berck | 235/134 |
| 2,722,382 | 11/1955 | Kihl et al. | 235/134 |
| 3,069,083 | 12/1962 | Haydon | 235/144 SP |
| 3,366,326 | 1/1968 | Sundblom | 235/134 |
| 3,545,649 | 12/1970 | Hummel et al. | 235/144 D |
| 3,727,833 | 4/1973 | Muller | 235/144 D |
| 3,848,113 | 11/1974 | Kelch et al. | 235/144 SP |

*Primary Examiner*—Joseph M. Thesz
*Attorney, Agent, or Firm*—J. Edward Hess; Donald R. Johnson; William C. Roch

[57] ABSTRACT

A register designed to count and display cost on a gasoline dispensing pump. The register has a 100 cent wheel which is driven by a stepping motor. As the 100 cent wheel rotates it biases a spring which, after the 100 cent wheel has completed a revolution, incrementally drives a dollar register wheel. Likewise, as the dollar wheel rotates it biases a spring which, after the dollar wheel has completed a revolution, incrementally drives a 10 dollar register wheel. The energy stored in the springs is also utilized to reset the register to zero, such that all of the power utilized to both drive and reset the register is supplied by the stepping motor.

7 Claims, 10 Drawing Figures

ELECTRO-MECHANICAL COUNTING REGISTER

BACKGROUND OF THE INVENTION

The present invention relates generally to a register, and more particularly relates to a register designed to count and display the monetary total of a gasoline dispenser pump. In the prior art mechanical registers for displaying gallons purchased and total sale in dollars have used mechanical counting wheels. These registers were typically driven by a solenoid hitting a ratchet wheel. These prior art mechanical registers have required a substantial amount of maintenance because of the wear inherent in their designs. One result of this disadvantage of prior art mechanical registers has been that many types of electronic registers have appeared on the market. Typically, these electronic registers use either a liquid crystal or hot filament display. These electronic displays are costly, require fairly expensive drive circuitry, have a relatively short life, and are often difficult to read in direct sunlight. It would be desirable to have a display which eliminates these problems.

SUMMARY OF THE INVENTION

In accordance with a preferred embodiment, an improved register is disclosed herein in which a stepping motor, in response to a pulsed input signal, drives a less significant register wheel. As the less significant wheel is rotated, it biases a spring to store energy which is later utilized to incrementally drive a more significant register wheel. The register further includes a reset mechanism which is also driven by the energy stored in the spring, with the result that only one power source, in the form of the stepping motor, is required to both drive and reset the register. This is an advantage over some prior art registers which required an additional power source to drive the reset mechanism. Further, since the less significant wheel is a 100 cents wheel, it may be driven at a slow rate which enables a rather small and nonpowerful stepping motor to be utilized. Also, the magnets within the stepping motor serve as magnetic detents for the 100 cent wheel. Another advantage of the disclosed embodiment is that during reset the register wheels are turned backward so that the amount shown by the display during reset is always less than the amount previously purchased. Another advantage of the disclosed embodiment is that the driving spring is biased over substantially the entire revolution of the less significant register wheel, with the result that a surge of power is not required from the motor to drive the more significant register wheel. Also, the output of the preferred embodiment is shown on mechanical register wheels, and consequently there is little difficulty in reading the register in intense sunlight. Further, the design of the disclosed embodiment results in a register which does not suffer the wear incurred by many prior art mechanical registers. A prototype of the disclosed register has demonstrated no appreciable wear in life tests equivalent to 10 years of normal use. Further, since the stepping motor is responsive to a pulsed input signal, an electronic pulse circuit, which may perform the calculations required at a gasoline dispenser, is inherently compatible with the disclosed register.

DETAILED DESCRIPTION OF AN EMBODIMENT

Figure 1:
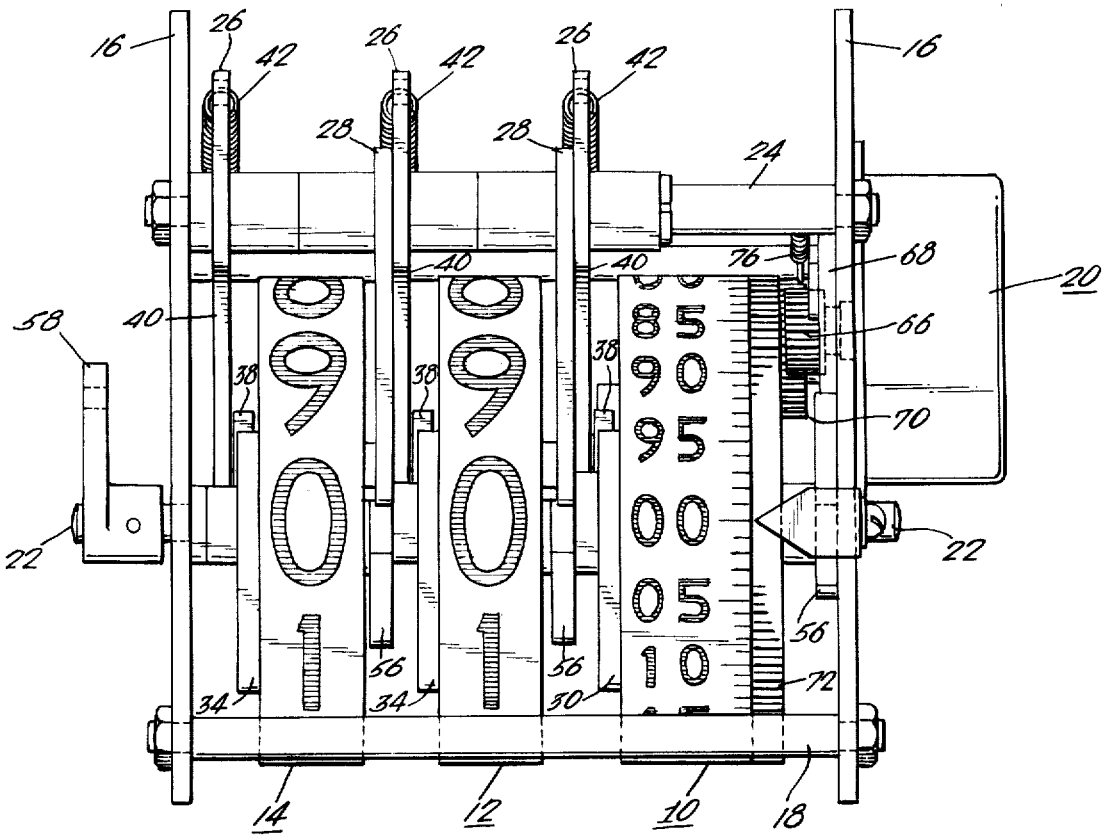
FIG. 1 is a perspective view of one embodiment of the present invention.

Referring to FIG. 1, there is illustrated a front view of one embodiment of the present invention. The register includes a less significant register wheel 10 which in the preferred embodiment is a 100 cent wheel, a next significant register wheel 12 which registers the amount of the purchase in dollars, and a most significant register wheel 14 which registers the amount of the purchase in tens of dollars. The register includes two main side frame members 16 which are secured together by a number of spacer elements 18. A stepping motor 20 is mounted on the right frame member 16, and drives the least significant register wheel 10 in a manner which will be explained later. The register includes a main shaft 22 about which the register wheels rotate, and an auxiliary shaft 24 about which a plurality of cam followers and restraining pawls rotate.

Figure 2:
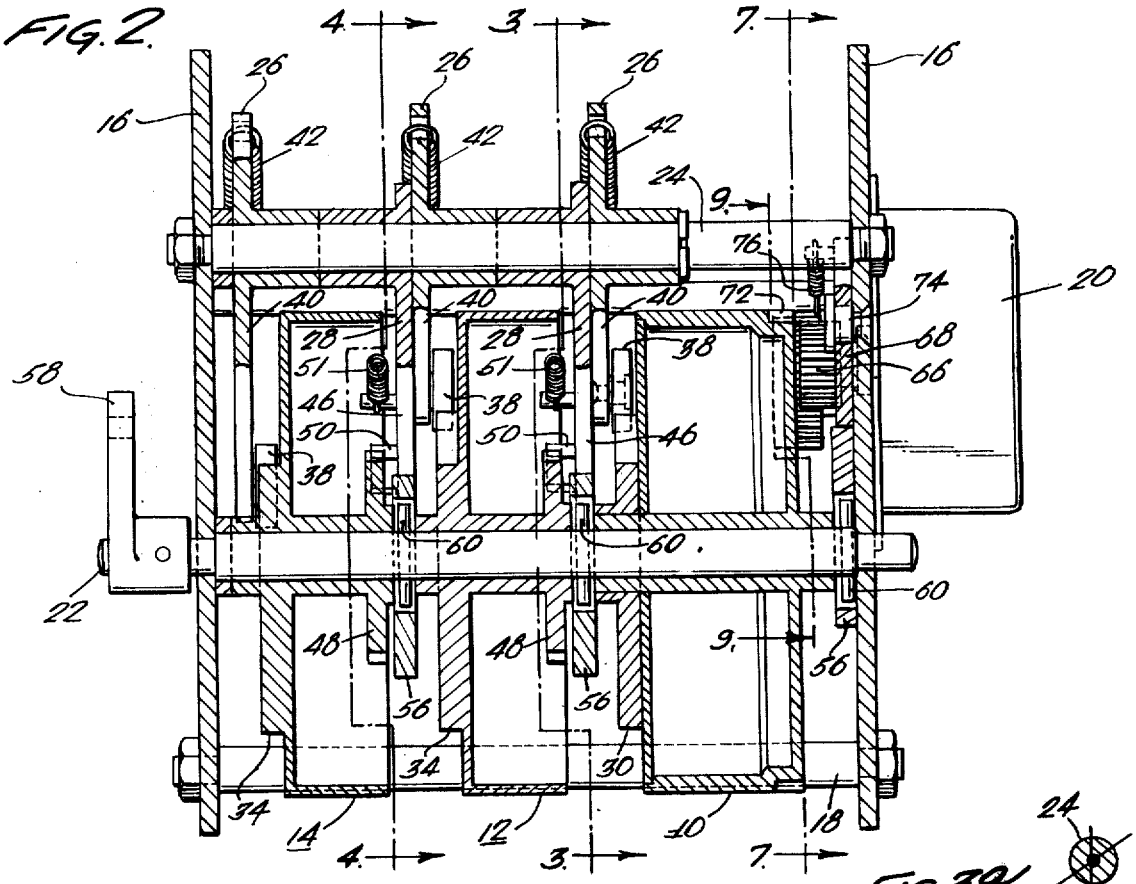
FIG. 2 is a cross sectional view showing details of the inside of the register.

FIG. 2 is a cross sectional view of the register showing the main shaft 22 and the auxiliary shaft 24. The 100 cent wheel 10, the dollar wheel 12 and the 10 dollar wheel 14 are all mounted for rotation about the main shaft 22. Three cam followers 26 and two restraining pawls 28 are shown mounted for rotation about auxiliary shaft 24. The stepping motor 20 drives the 100 cent wheel in 3.6° increments such that the 100 cent wheel rotates once completely for each 100 pulses into the stepping motor. Each complete revolution of the 100 cent wheel 10 causes the dollar wheel 12 to rotate through a 36° increment, and each complete revolution of the dollar wheel 12 causes the 10 dollar wheel 14 to rotate through a 36° increment.

Figure 3:
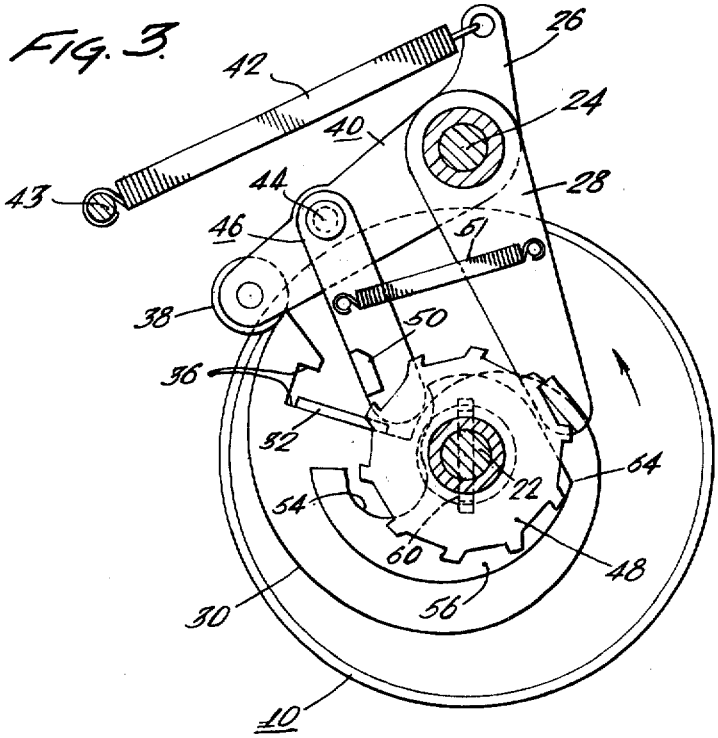
FIGS. 3, 3*a*, and 3*b*, show some of the details of a cross sectional view taken along line 3—3 of FIG. 2 at different times during a cycle of operation.
Figure 3A:
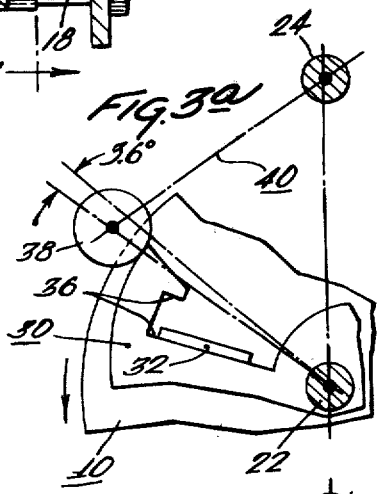
Figure 3B:
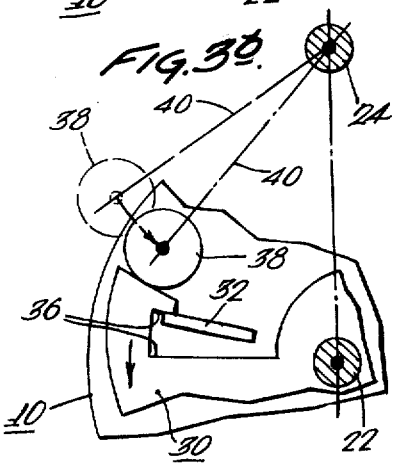

The register operates as follows. Referring to FIGS. 2 and 3, as register wheel 10 is incrementally rotated by the stepping motor 20 it drives a snail cam 30 by means of a key 32. Similarly register wheels 12 and 14 drive snail cammed surfaces 34 as they rotate but with one difference. The 100 cent wheel 10 is rotated in 3.6° increments, while the register wheels 12 and 14 are rotated in 36° increments. The larger rotational increments of register wheels 12 and 14 allows the driving mechanisms for those wheels to operate properly while having the cammed surfaces 34 directly attached and made a part of the register wheel. The small 3.6° rotational increments of the 100 cent wheel requires that the cammed surface 30 be loose with respect to the register wheel in order for the driving mechanism to function properly, as will be explained more fully later. This play between key 32 and cam 30 is best illustrated in FIG. 3*a* and *b* wherein it may be seen that the cam 30 may rotate the distance 36 with respect to the key 32. Returning to the explanation, rotation of wheel 10 and cammed surface 30 causes a roller 38 which rides on the cammed surface to rise, thereby causing cam follower arm 40 on which roller 38 is mounted, to rotate clockwise (as seen in FIG. 3) against the bias of a tensioned spring 42. Spring 42 is coupled to a post 43 which extends between the side frame members 16. Cam follower 40 carries pivot 44 and driving pawl 46 along, and pawl 46 slides along a drive, ratchet wheel 48, which is physically connected to the one dollar wheel 12, until a projection 50 on the pawl 46 slips past the next tooth on the ratchet wheel. This action occurs at approximately 98 cents on the register. At 99 cents, the roller 38 is at the very top of the cam, shown in FIG. 3. At 00 cents, the roller is carried past the top point of the cam, and spring 42 urges the cam follower arm to rotate counterclockwise about the auxiliary shaft 24, causing the roller to push the cam 30 a distance 36 in a counterclockwise direction, thereby moving cammed surface 30 out of the way of roller 38 and allowing roller 38 to fall to the bottom of the cammed surface. As roller 38 falls, projection 50 contacts a tooth on ratchet wheel 48 and urges the ratchet wheel through a 36° increment and thereby rotating the dollar wheel by a 36° increment and adding 1 dollar to the registered price. As the ratchet wheel rotates, the restraining pawl 28, which also rotates about auxiliary shaft 24, and which is coupled via a tensioned spring 51 to the driving pawl 46, is moved out of the way and snaps behind the next tooth on the ratchet wheel. A similar restraining pawl 28 is provided for the ten dollar register wheel 14 as the constant pressure of the roller on the cam would tend to rotate the wheel backward toward a zero position on the register. The restraining pawls 28 prevent this backward rotation, except in a reset mode as will be described later.

Figure 4:
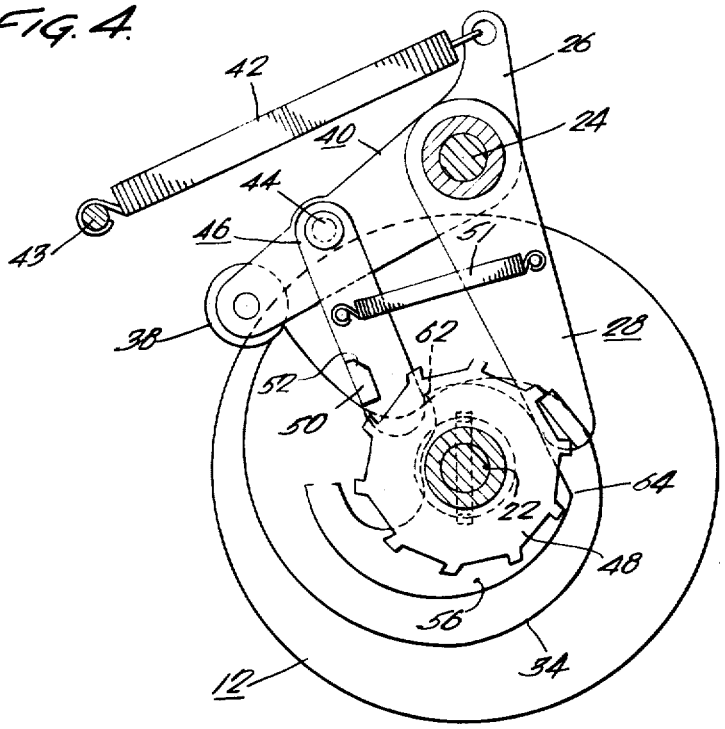
FIGS. 4, 5 and 6 show some of the details of the same cross sectional view taken along line 4–7 of FIG. 2 but illustrate different times during the sequence of operation of the register.
Figure 5:
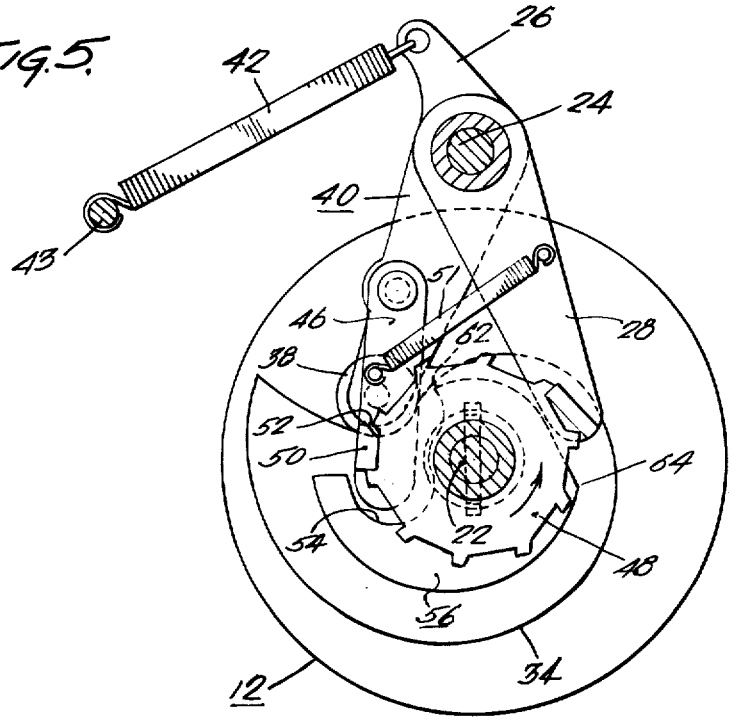

FIGS. 4 and 5 illustrate the sequence of actions of the cam followers, the pawls and the ratchet wheels for the driving mechanism between register wheels 12 and 14. With the exception that the cammed surface 34 is an integral part of the register wheel 12, the functions of the various elements are exactly the same for all of the register wheel drive mechanisms. In FIG. 4, the roller 38 has arrived at the top of the cammed surface 34, the driving pawl 46, and particularly its projection 50, has slipped over the tooth of the ratchet wheel 48, while restraining pawl 28 prevents the ratchet wheel 48, and the register wheel 14 to which it is attached, from rotating.

FIG. 5 illustrates the next step in the sequence. From FIG. 4 to FIG. 5, the dollar wheel 12 has just been rotated through a 36° increment by the driving pawl 46 which cooperates with the cam on the 100 cent register wheel 10 (all of this structure being shown in FIG. 3). This 36° incremental rotation allows the cammed surface 34 to be attached directly to the wheel 13 as the 36° rotation allows the top of the cam to be rotated fully out of the path of roller 38. With the 100 cent wheel, the rather small 3.6° rotation made it necessary to allow the cam to be moved backward relative to the roller. The roller 38 then proceeds to the bottom of the cammed surface as shown in FIG. 5, with driving pawl 46 and particularly projection 50 thereon driving ratchet wheel 48, and thereby the 10 dollar register wheel 14, through a 36° incremental rotation. The inertia of the ratchet wheel 48 and the 10 dollar register wheel 14, at this point, would tend to cause the wheel to continue rotating past its proper point. This is prevented by the contact of the next ratchet tooth on the slanted surface 52 on the back of projection 50. The surface 52 is slanted to allow the projection 50 to clear the next tooth as the driving mechanism goes through the next cycle. The angle of the surface 52 would also cause the pawl to be thrown outward by the inertia of the 10 dollar wheel in the driving sequence presently being described. To prevent this, a cavity 54 is provided within a reset cam 56, which is in the same plane as the driving pawl 46 to prevent the driving pawl from being thrown outward. The other functions of this reset cam will be explained later during the description of the reset mechanism. The above cycle is repeated for all of the driving mechanisms, with the 1 dollar wheel being driven through a 36° angle increment for each complete revolution of the 100 cent wheel and the 10 dollar wheel being driven through a 36° increment for each complete revolution of the one dollar wheel.

Figure 8:
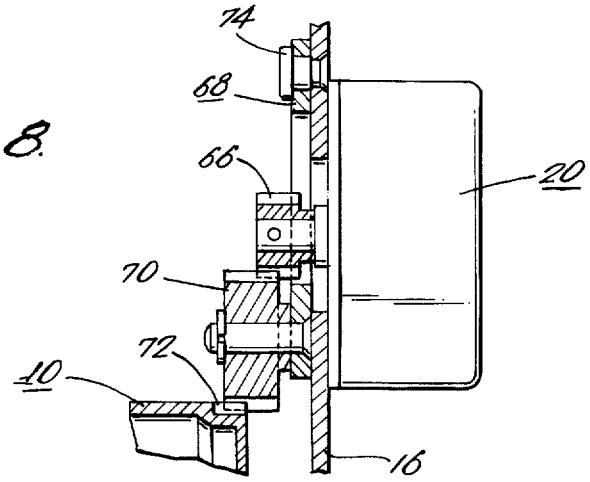
FIG. 8 is a cross sectional view taken along line 8—8 of FIG. 7, and shows additional details of the reset mechanism.
Figure 6:
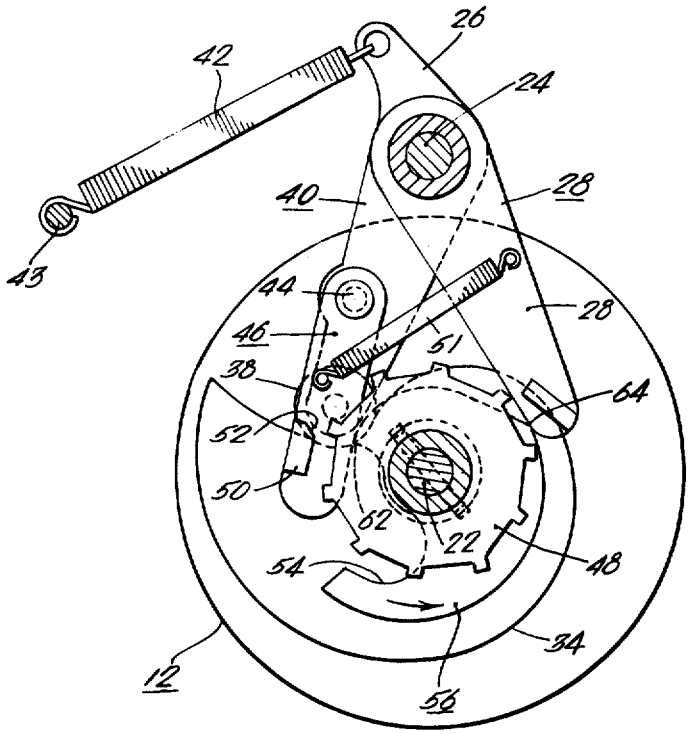
Figure 7:
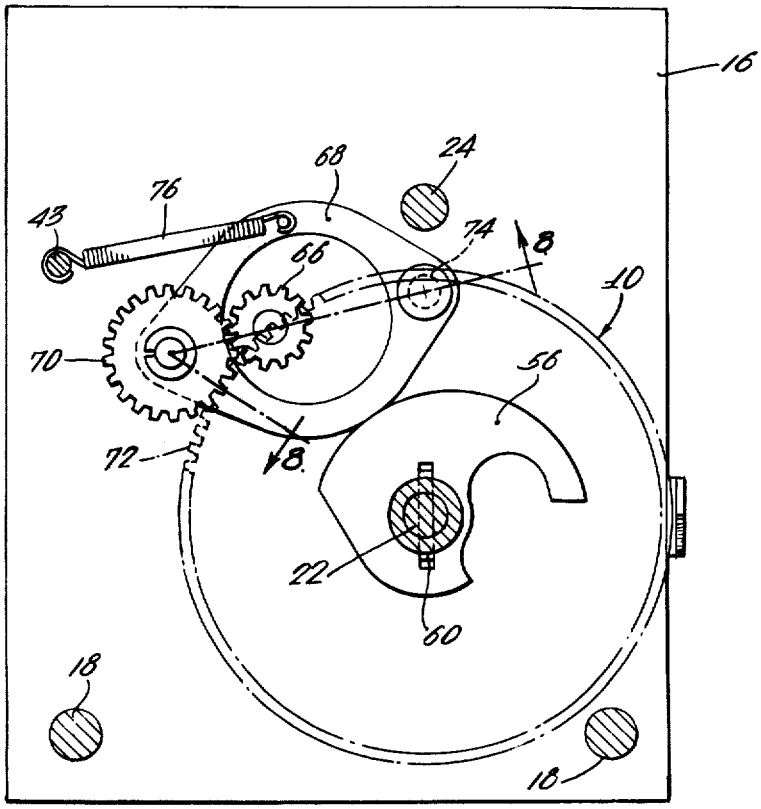
FIG. 7 is a cross sectional view taken along line 7—7 of FIG. 2 and shows further details of the reset mechanism.

The reset mechanism will now be described. As was previously mentioned, the spring action on the arms and rollers tends to rotate the cams and therefore all wheels backwards. This tendency is resisted in the 100 cent wheel by the magnetic detents in the stepping motor, and in the other two wheels by restraining pawls. The main shaft 22 does not rotate during the counting cycle as it is held stationery by a reset arm 58, shown in FIG. 2. The register is reset by rotating the main shaft 22, as by a solenoid, 40° counterclockwise as shown in FIG. 6. In FIGS. 4–6, it may be seen that the reset cam 56 is attached to the main shaft 22 by a pin 60. In a similar fashion, rotation of the main shaft causes rotation of all three reset cams 56, shown in FIG. 2. As previously mentioned, the reset cam is in the same plane as the driving pawl. It is also in the same plane as the restraining pawl, as best seen in FIG. 2. As the reset cam 56 is rotated counterclockwise to the position shown in FIG. 6, the driving pawl is lifted off the ratchet wheel by point 62 in the reset cam. Likewise, the restraining pawl is lifted off the ratchet wheel 48 by point 64 on the reset cam. With these restraints removed, the roller 38, bearing on the cammed surface 34 under the influence of tensioned spring 42, causes the register wheel to rotate backwards until the roller 38 is at the lowest point on the cam, as shown in FIG. 6, and at that point the register wheel is reset to zero. It should be noted that when reset cam 48 is rotated 40° counterclockwise the cavity 54, which normally entraps the driving pawl 46, is rotated out of the way of the driving pawl as shown in FIG. 6. After resetting, the reset arm 58 is released, and the spring 5 which extends between the two pawls draws the pawls back into position for another counting cycle. Reference should also be made to FIGS. 7 and 8 for an explanation of a reset of the 100 cent wheel. As shown more clearly in FIG. 8, the stepping motor 20 has a driving gear 66 which extends through a frame member 68 to an idler gear 70 which normally bears against a set of 100 gear teeth 72 which are an integral part of the 100 cent wheel. The frame member 68 rotates about a shaft 74, and is urged in a counterclockwise direction by a tensioned spring 76. This counterclockwise urging of the frame member 68 results in idler gear 70 being urged against the set of 100 gear teeth 72 in the perimeter of the 100 cent wheel. During a resetting operation, resetting cam 56 is rotated 40° counterclockwise, which increases the radius thereof bearing against the frame 68, and results in the lifting of idler gear 70 off the set of gear teeth 72. Note that gear 72 has 100 teeth, so that wherever the 100 cent wheel has stopped after reset, there is a gear tooth space in the same position as a tooth space in the zero position, so that the tooth in idler gear 70 that meshed with a particular tooth space before resetting will find a tooth space in the same place in the reset, zero position.

Although the illustrated embodiment shows only three register wheels, there is no limit to the number of wheels that can be used without increasing the size of the motor or the strength of the springs. This is because the stepping motor only drives the 100 cent wheel and the driving spring 42 at any one time. The energy stored in the driving spring 42 is then utilized to drive only the next significant register wheel, and as that wheel is driven it gradually stores energy in the next driving spring is utilized to drive the next wheel, and etc. This concept can be thought of as a mathematical series which gradually approaches but never reaches a limiting value.

Although the disclosed embodiment is a cost of purchase register, the principles of this invention are applicable to other types of totalizing registers. Also, although in the preferred embodiment the least significant register wheel is a 100 cent wheel, in other embodiments the least significant wheel may be driven in other angular increments. For instance, the least significant wheel could be a 10 cent wheel, but this would require a faster rotation of the least significant wheel and a more powerful and larger stepping motor.

Although at least one embodiment of the present invention has been described, the teachings of this invention will suggest many other embodiments to those skilled in the art.

The invention claimed is:

1. An approved register comprising:

a main shaft;

b. a less significant register wheel mounted on said main shaft;

c. means for driving said less significant register wheel, whereby it may be driven to register a measured quantity;

d. a more significant register wheel mounted on said main shaft;

e. a drive wheel coupled to said more significant register wheel for rotation therewith;

f. a snail cam coupled to said less significant register wheel for rotation therewith;

g. a cam follower positioned to follow the contour of said snail cam;

h. a spring coupled to said cam follower for accumulating a storing energy as said less significant register wheel is driven through substantially an entire revolution;

i. a driving pawl coupled to said drive wheel and said cam follower for driving said more significant register wheel through a predetermined portion of a revolution after said less significant register wheel has substantially completed one revolution;

j. a restraining pawl, coupled to said drive wheel, for restraining rotational movement of said more significant wheel unless said driving pawl is driving said more significant register wheel;

k. a first reset cam, coupled to said main shaft for rotational movement therewith and also coupled to said driving and restraining pawls, for lifting said driving and restraining pawls upon rotation of said main shaft during a resetting operation; and l. means for resetting the register to zero and including means for rotating said main shaft during a resetting operation, whereby said reset cam will lift said driving and restraining pawls from said drive wheel during the resetting operation.

2. An improved register as set forth in claim 1 wherein said first reset cam is provided with a cavity which overlies said driving pawl after said driving pawl drives said more significant register wheel through a predetermined portion of a revolution to prevent said more significant register wheel from rotating more than said predetermined portion of a revolution.

3. An improved register as set forth in claim 1 wherein said means for driving said less significant register includes a stepping motor, responsive to a pulsed input signal, for driving said less significant register wheel a step at a time.

4. A register as set forth in claim 3 wherein said less significant register wheel is a one 100 cent wheel, and said stepping motor drives said less significant register wheel in 3.6° steps.

5. An improved register as set forth in claim 4 and further including:

a. a drive mechanism for coupling said stepping motor to said less significant register wheel; and b. a second reset cam, coupled to said main shaft for rotational movement therewith, and also coupled to said drive mechanism for the less significant register wheel, for disengaging the drive mechanism from the less significant register wheel during a resetting operation.

6. An improved register as set forth in claim 5 wherein said first reset cam is provided with a cavity which overlies said driving pawl after said driving pawl drives said more significant register wheel through a predetermined portion of a revolution to prevent said more significant register wheel from rotating more than said predetermined portion of a revolution.

7. An improved register as set forth in claim 3 and further including:

a. a drive mechanism for coupling said stepping motor to said less significant register wheel; and b. a second reset cam, coupled to said main shaft for rotational movement therewith, and also coupled to said drive mechanism for the less significant register wheel, for disengaging the drive mechanism from the less significant register wheel during a resetting operation.

* * * * *